United States Patent [19]

Wulf et al.

[11] Patent Number: 4,900,225

[45] Date of Patent: Feb. 13, 1990

[54] CENTRIFUGAL COMPRESSOR HAVING HYBRID DIFFUSER AND EXCESS AREA DIFFUSING VOLUTE

[75] Inventors: James B. Wulf, Williamsville; Timothy D. Craig, Buffalo; Alfred P. Evans, Orchard Park; Ross H. Sentz, Williamsville, all of N.Y.

[73] Assignee: Union Carbide Corporation, Danbury, Conn.

[21] Appl. No.: 320,605

[22] Filed: Mar. 8, 1989

[51] Int. Cl.[4] ..... F04D 29/42

[52] U.S. Cl. ..... 415/224.5; 415/207; 415/212.1

[58] Field of Search ..... 415/203, 204, 206, 207, 415/211.1, 211.2, 212.1, 224.5, 208.3

[56] References Cited

U.S. PATENT DOCUMENTS

| | | | |
|---|---|---|---|
| 1,886,714 | 11/1932 | Moss | 415/111 |
| 2,291,478 | 7/1942 | La Bour | 415/207 |
| 2,836,347 | 5/1958 | Barr et al. | 415/228 |
| 3,289,921 | 12/1966 | Soo | 415/207 |
| 3,604,818 | 9/1971 | Cronstedt | 415/208.3 |
| 3,658,437 | 4/1972 | Soo | 415/181 |
| 3,860,360 | 1/1975 | Yu | 415/208.3 |
| 3,904,308 | 9/1975 | Ribaud | 415/208.3 |
| 3,904,312 | 9/1975 | Exley | 415/208.3 |
| 3,905,721 | 9/1975 | Fitzpatrick | 415/208.3 |
| 3,963,369 | 6/1976 | Balje | 415/148 |
| 3,964,837 | 6/1976 | Exley | 415/208.3 |
| 3,973,872 | 8/1976 | Seleznev et al. | 415/208.3 |
| 3,997,281 | 12/1976 | Atkinson | 415/207 |
| 4,181,466 | 1/1980 | Owen | 415/204 |
| 4,219,305 | 8/1980 | Mount et al. | 415/13 |
| 4,389,159 | 6/1983 | Sarvanne | 415/224.5 |
| 4,416,583 | 11/1983 | Byrns | 415/148 |
| 4,579,509 | 4/1986 | Jacobi | 415/199.1 |
| 4,626,168 | 12/1986 | Osborne et al. | 415/211 |
| 4,770,605 | 9/1988 | Nakatomi | 415/148 |

OTHER PUBLICATIONS

Ludtke, Aerodynamic Tests on Centrifugal Process Compressors, Journal of Engineering for Power, vol. 105, Oct. 1983, pp. 902–909.

Yingkang & Sjolander, Effect of Geometry on the Performance of Radial Vaneless Diffusers, Transactions of the ASME, May 31, 1987.

*Primary Examiner*—Robert E. Garrett
*Assistant Examiner*—John T. Kwon
*Attorney, Agent, or Firm*—Stanley Ktorides

[57] ABSTRACT

A centrifugal compressor having a two section diffuser which has a tapered section having a constant diffusing area along its radial length, and a straight section having an increasing diffusing area along its radial length, and a diffusing volute having a throat area significantly larger than conventional designs.

6 Claims, 4 Drawing Sheets

CENTRIFUGAL COMPRESSOR HAVING HYBRID DIFFUSER AND EXCESS AREA DIFFUSING VOLUTE

TECHNICAL FIELD

The invention relates generally to the field of centrifugal compressors which are employed to increase the pressure of a fluid.

BACKGROUND ART

Centrifugal compressors are employed in a wide variety of applications where it is desired to increase the pressure of a fluid. One particularly important application is in the industrial gas industry wherein centrifugal compressors are employed to pressurize feed air prior to cryogenic rectification into product industrial gases, or to pressurize industrial gases prior to liquefication.

A centrifugal compressor is comprised of a rotatable centrally oriented shaft, an impeller wheel mounted on the shaft, a diffuser leading radially outward from the impeller wheel to a volute, and an exit communicating with the volute. Gas flows into the centrifugal compressor and flows between curved blades mounted on the impeller wheel. The rotating shaft-wheel assembly imparts a velocity to the fluid. The velocity is converted to pressure energy as the gas passes sequentially through the diffuser, volute, and exit.

Centrifugal compressors consume very large amounts of power, such as electrical power. In some applications, such as in the cryogenic rectification of air wherein the pressure of the feed air constitutes essentially all of the energy input to the process, the energy consumed by a centrifugal compressor is a major cost consideration and even a small improvement in centrifugal compressor efficiency will have a significant positive impact on the economics of the process. Centrifugal compressor efficiency may be defined as the measure of the energy required to raise the pressure of a given fluid from a first to a second pressure.

Accordingly it is an object of this invention to provide a centrifugal compressor for increasing the pressure of a fluid at greater efficiency than heretofore available centrifugal compressors.

SUMMARY OF THE INVENTION

The above and other objects which will become apparent to one skilled in the art upon a reading of this disclosure are attained by the present invention which is:

A centrifugal compressor comprising:

(A) a rotatable shaft;

(B) an impeller wheel mounted on the shaft;

(C) a diffuser extending radially from a diffuser entrance at the impeller wheel to a diffuser exit at a volute, said diffuser having a tapered section extending from the diffuser entrance to an intermediate point and a straight section extending from the intermediate point to the diffuser exit, said tapered section having a constant diffusing area along its radial length and said straight section having an increasing diffusing area along its radial length; and (D) a volute throat area within the range of from 70 to 90 percent of the area of the diffuser exit.

As used herein, the term "diffuser" means a stationary device for converting a portion of the kinetic energy of a fluid to pressure energy of the same fluid.

As used herein the term "volute" means a stationary device for collecting the fluid exiting a diffuser and directing the fluid to a single exit port. The flow area of a volute varies circumferentially.

As used herein the term "diffusing area" means the area of the radial cross-section of a diffuser through which fluid flows both radially and circumferentially from the impeller to the volute.

As used herein, the term "volute throat area" means the volute cross-sectional area at the outlet where all of the fluid flow has been collected.

DETAILED DESCRIPTION

For purposes of particularly pointing out and describing in detail the improvement which forms the present invention, a description of a conventional centrifugal compressor will be first presented.

Figure 1:
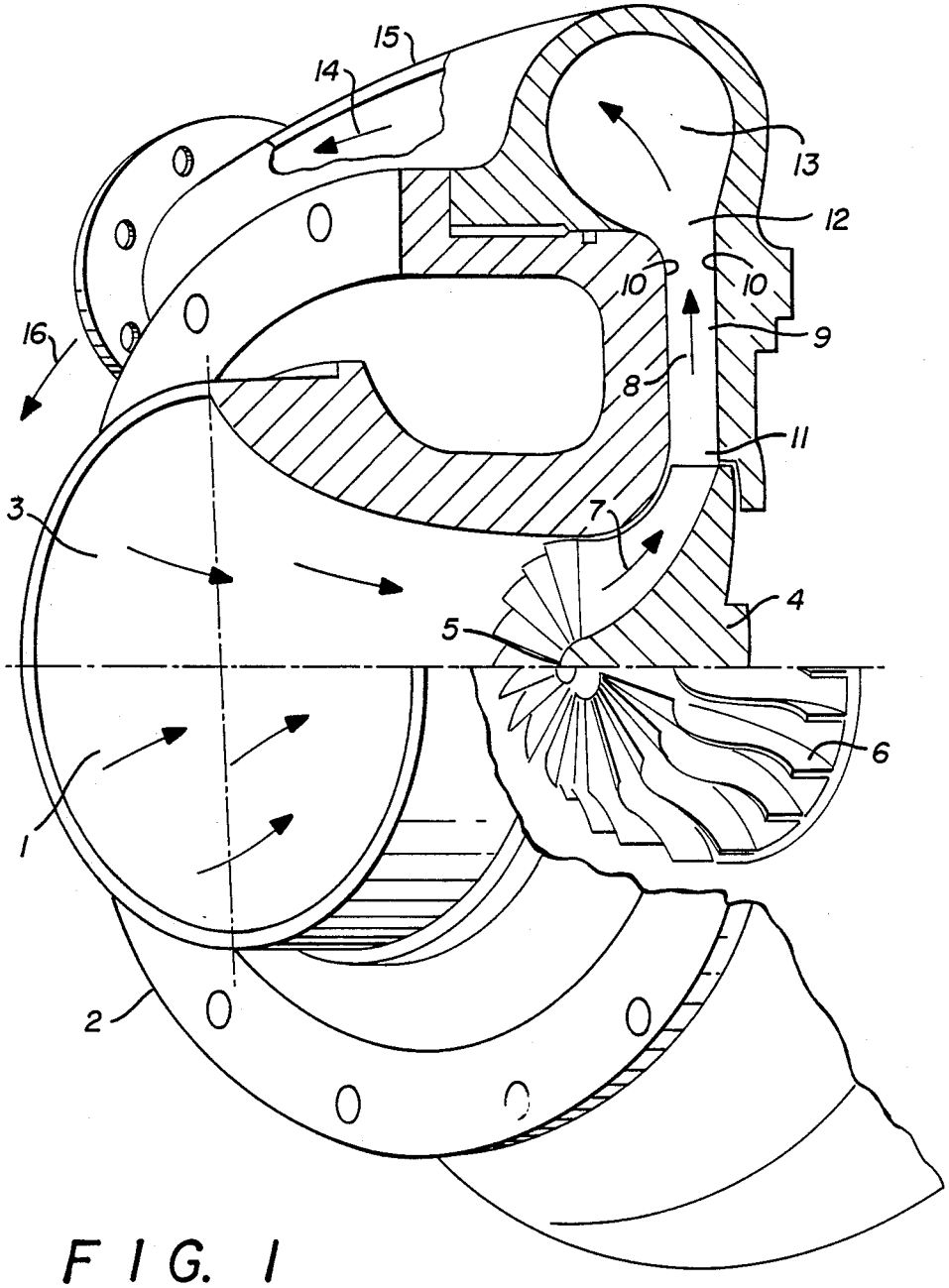
FIG. 1 is an illustration partly cut away and partly in cross-section showing a conventional centrifugal compressor.

Referring now to FIG. 1 which illustrates a conventional centrifugal, compressor, fluid, i.e. gas, represented by arrows 1, is drawn into centrifugal compressor 2 through entrance 3. Impeller wheel 4 is mounted on rotatable shaft 5. Curved blades 6 are mounted on impeller wheel 4. Fluid passes 7 through the spaces between blades 6. The rotating impeller wheel assembly serves to increase the velocity of the fluid and to impart centrifugal force to the fluid as the fluid passes 7 through the assembly.

After passing through the impeller wheel assembly, the fluid passes 8 through diffuser 9. In FIG. 1, diffuser 9 is shown having conventional parallel straight sides 10. Since diffuser 9 extends radially outward from the impeller wheel assembly, the area through which fluid passes as it flows through diffuser 9, i.e. the diffusing area, is constantly increasing along the radial length of the diffuser from 11 at the diffuser entrance from the impeller wheel to 12 at the diffuser exit at the volute. Since the diffusing area of diffuser 9 is constantly increasing along its radial length from 11 to 12, fluid 8 is constantly being decelerated as it passes through diffuser 9. Thus the fluid velocity is diffused and converted into pressure.

Pressurized fluid then passes through diffuser exit 12 into volute 13. The function of the volute is to collect the fluid exiting the diffuser and direct it to a single common exit port. Whether or not the velocity of the fluid changes in the volute is a strong function of the area schedule of the volute. The area available for flow, i.e. the cross-sectional area, varies circumferentially. At the volute throat, all of the fluid exiting the diffuser has been collected. Fluid velocity at the volute throat must adjust to satisfy the mass flow rate.

It is desired that fluid flow energy losses between the diffuser exit and the volute throat be minimized and thus it is desired that there be no velocity change in the fluid from the diffuser exit to the volute throat. Accordingly volute throats are conventionally designed so that the product of the area of the volute throat and the fluid tangential velocity equals the product of the area of the diffuser exit and the fluid radial velocity. In practice this results in a volute throat area which is no more than about 58 percent of the diffuser exit area.

After the fluid passes through the volute throat, it passes 14 through exit 14 and out 16 of centrifugal compressor 2. Pressurized fluid 16 passes through appropriate conduit means and ultimately to a use point such as, in the case where the fluid is air, to, for example, a cryogenic air separation plant.

Conventional centrifugal compressors, such as illustrated and discussed with respect to FIG. 1, generally achieve efficiencies within the range of from 75 to 80 percent. While this may be acceptable for many applications, it would be desirable, as discussed above, to have a centrifugal compressor which operates at higher than conventional efficiency.

Figure 2:
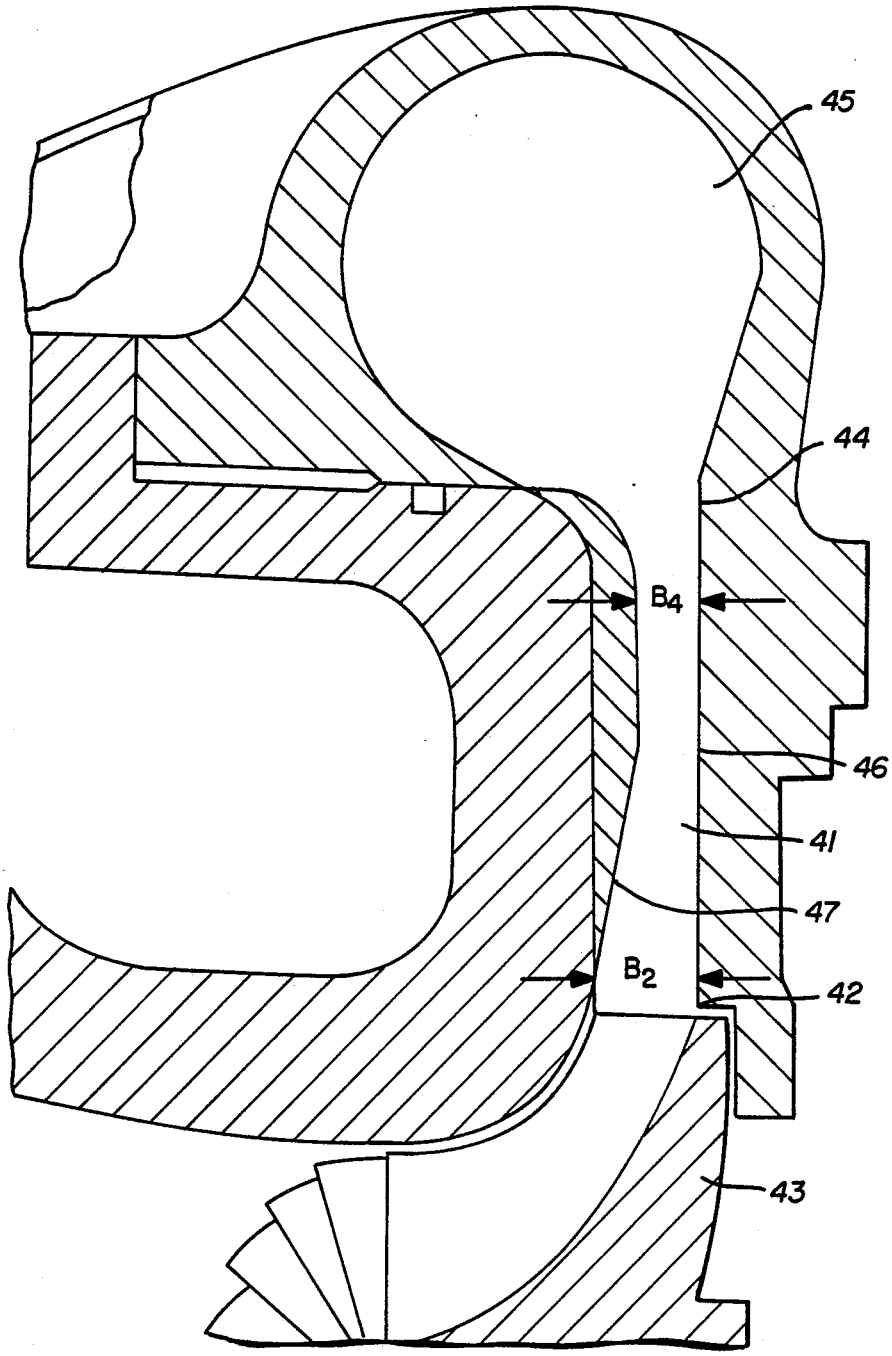
FIG. 2 is a cross-sectional view of one embodiment of the centrifugal compressor of this invention.

FIG. 2 illustrates in cross section one embodiment of improved centrifugal compressor of this invention. Referring now to FIG. 2, diffuser 41 extends radially from the diffuser entrance 42 at exit of impeller wheel 43 to the diffuser exit 44 at volute 45. Hybrid diffuser 41 has two sections, a first or tapered section which extends from entrance 42 to an intermediate point 46, and a second or straight section which extends from intermediate point 46 to exit 44. The straight section has parallel straight walls so that the diffusing area increases radially through this section. However the tapered section has at least one wall 47 which is at an angle such that the diffusing area in the tapered section remains substantially constant from entrance 42 to intermediate point 46.

Hybrid diffuser 41 generally has a radial length within the range of from 0.8 to 1.2 times the radius of impeller wheel 43 and preferably its radial length i.e. its length from entrance 42 to exit 44, is about equal to the radius of impeller wheel 43. The radial length of the straight section of hybrid diffuser 41 is preferably within the range of from 20 to 50 percent of the total radial length of the diffuser, with the tapered section comprising the remainder of the diffuser. The pinch ratio, which is defined as the ratio of the difference between the diffuser opening at the entrance and the diffuser opening at the straight section to the diffuser opening at the entrance, i.e. $(B_2-B_4)/B_2$ as shown in FIG. 2, is preferably within the range of from 0.3 to 0.5 and most preferably is about 0.4.

In has been found that a centrifugal compressor having the hybrid diffuser of this invention operates with significantly improved efficiency over that of a comparable centrifugal compressor having a conventional diffuser. Without being held to any particular theory, applicants offer the following possible explanation for this improvement. The two-part diffuser reduces energy losses because the inherently disorganized flow exiting the impeller becomes a more uniform flow more rapidly in the tapered section and a more uniform flow diffuses more efficiently. In addition the tapered section reduces the flow path length thereby decreasing surface frictional losses. However, if the tapered section is maintained throughout the entire length of the diffuser the fluid velocity may not be sufficiently decreased resulting in increased volute energy losses.

Another characteristic of the centrifugal compressor of this invention is a novel volute throat which combines with the hybrid diffuser to provide a further improvement in compressor efficiency.

Figure 3:
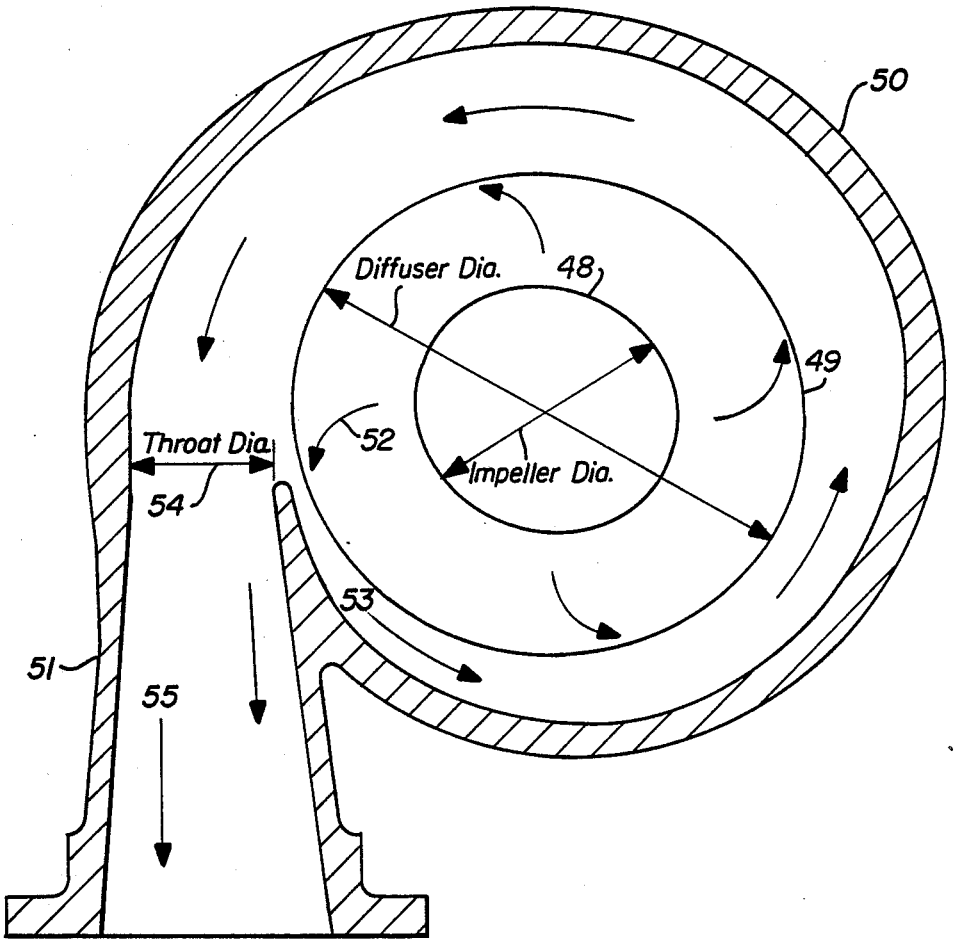
FIG. 3 is a cross-sectional view of the volute associated with the centrifugal compressor of this invention.
Figure 4:
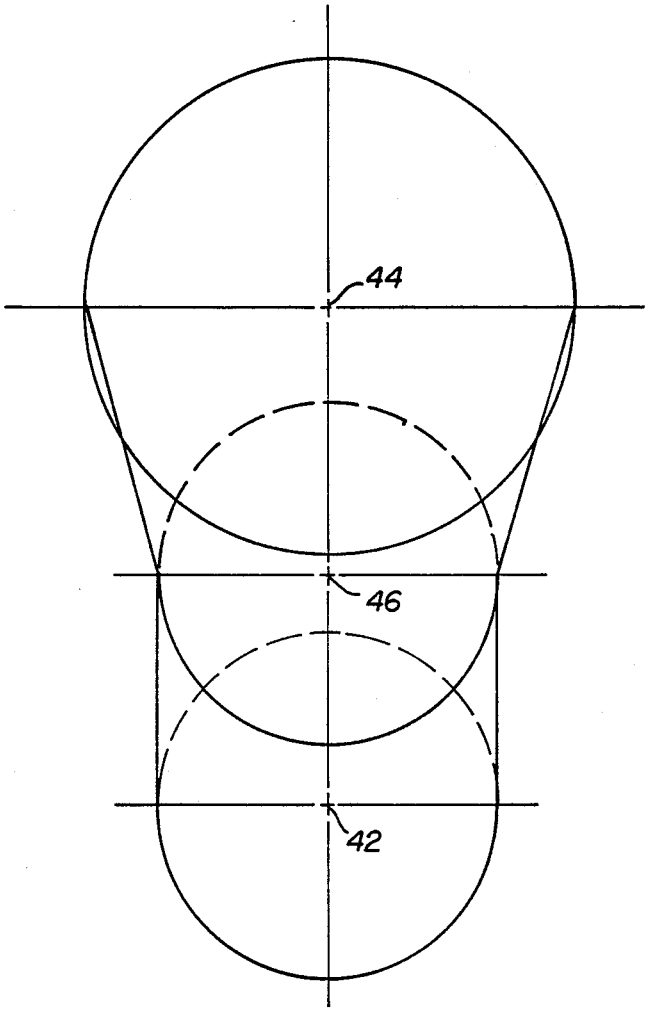
FIG. 4 is a representational view of the diffuser illustrated in FIG. 2 showing cross-sectional views of the diffusing area along the radial length of the diffuser from point 42 to point 46 to point 44.

FIG. 3 shows a cross-sectional view of the volute and its relationship to the impeller and diffuser. The impeller outer diameter 48 is surrounded by the radial diffuser with its outer diameter 49. The volute 50 in turn surrounds the diffuser and is connected to the exit diffuser 51. As can be seen, the fluid flow progresses from the impeller and through the radial diffuser as shown by arrows 52. The fluid exiting from the diffuser is collected by the volute around its circumference and then exits through the volute throat. The volute flow area is lowest in the region as indicated by flow arrow 53 and gradually increases around the circumference to the throat region. At the volute throat, all of the fluid has been collected and exits, as shown by flow arrow 55, to the machine exit diffuser 51. The diameter of the volute throat 54 is indicated at the outlet of the volute.

As discussed above, conventional centrifugal compressor design requires that for a minimization of energy losses between the diffuser exit and the volute throat, the volute throat area should be equal to the diffuser exit area times the ratio of the fluid radial velocity to the fluid tangential velocity, which in practice results in a volute throat area to diffuser throat area ratio of not more than about 0.58. Surprisingly, it has been found that energy losses may be further reduced if the volute throat area exceeds the product of the diffuser exit area and the fluid radial to tangential velocity ratio and that this further energy loss reduction is best attained when the ratio of the volute throat area to the diffuser exit area is within the range of from 0.70 to 0.90 and most preferably is within the range of from 0.75 to 0.85.

It is understood that although the volute throat area is specified, the volute flow area at other circumferential locations is correspondingly increased. Generally, the volute area change at circumferential positions other than the volute throat will be in the same ratio as any change at the volute throat. Of course, for any volute throat area, the volute area at other circumferential positions will be less as dependent on collected fluid flow at that point. For example, at a circumferential position diametrically opposite to the throat location, the volute area will be about one-half of the volute throat area.

Without being held to any particular theory, applicants believe this improvement may be explained as follows. After the fluid leaves the diffuser, the radial velocity at the diffuser exit is partially converted to swirl in the volute. The tangential velocity of the fluid exiting the diffuser is caused to decrease by the larger volute area. Thus velocity is more efficiently diffused and converted to pressure.

The following examples and comparative example serve to further illustrate or distinguish the centrifugal compressor of this invention. They are not intended to be limiting.

COMPARATIVE EXAMPLE

A centrifugal compressor similar to that illustrated in FIG. 1 having an impeller radius of 5.53 inches and a diffuser having a length equal to that of the impeller radius was used to compress air from a pressure of 13.7 pounds per square inch absolute (psia) to 20.5 psia. The compressor had a volute throat area to diffuser exit area ratio of 0.35 and had a two section diffuser where 17 percent of the diffuser length was tapered having a pinch ratio of 0.05. The compressor operated with an efficiency of 80.7 percent. Compressor efficiency is calculated as the ratio of the ideal to actual energy required to raise the pressure of a fluid from the inlet conditions to the discharge pressure wherein the ideal compression is isentropic.

EXAMPLE 1

A centrifugal compressor comparable to that used in the Comparative Example but employing the hybrid diffuser of this invention was employed to carry out a compression similar to that described in the Comparative Example. The hybrid diffuser had a straight section which comprised 24.1 percent of the total diffuser length and had pinch ratio of 0.40. The compressor operated with an efficiency of 83.9 percent.

EXAMPLES 2 AND 3

A centrifugal compressor comparable to that used in Example 1 was similarly employed in two further tests but with the pinch ratios being 0.30 and 0.50 respectively. The compressor operated with an efficiency of 83.2 for the 0.30 pinch ratio embodiment and with an efficiency of 83.0 for the 0.50 pinch ratio embodiment.

EXAMPLE 4

A centrifugal compressor comparable to that used in Example 1 but having a volute throat area to diffuser exit area ratio of 0.85 was similarly employed. The compressor operated with an efficiency of 87.5 percent.

As can be clearly seen from the examples, the centrifugal compressor of this invention provides a significant increase in efficiency over that attainable by centrifugal compressors which do not employ the improvements of this invention.

Now by the use of the centrifugal compressor of this invention one can carry out compression with significantly higher efficiency than possible with heretofore available centrifugal compressors. Although the invention has been described in detail with reference to certain embodiments, those skilled in the art will recognize that there are other embodiments of the invention within the spirit and scope of the claims.

We claim:

1. A centrifugal compressor comprising:

(A) a rotatable shaft;

(B) an impeller wheel mounted on the shaft;

(C) a diffuser extending radially from a diffuser entrance at the impeller wheel to a diffuser exit at a volute, said diffuser having a tapered section extending from the diffuser entrance to an intermediate point and a straight section extending from the intermediate point to the diffuser exit, said tapered section having a constant diffusing area along its radial length and said straight section having an increasing diffusing area along its radial length; and (D) a volute throat area within the range of from 70 to 90 percent of the area of the diffuser exit.

2. The centrifugal compressor of claim 1 wherein the diffuser has a total radial length with the range of from 0.8 to 1.2 times the radius of the impeller wheel.

3. The centrifugal compressor of claim 1 wherein the diffuser straight section comprises from 20 to 50 percent of the total radial length of the diffuser.

4. The centrifugal compressor of claim 1 wherein the diffuser has a pinch ratio within the range of from 0.30 to 0.50.

5. The centrifugal compressor of claim 1 wherein the diffuser has a pinch ratio of about 0.40.

6. The centrifugal compressor of claim 1 wherein the volute has a throat area within the range of from 75 to 85 percent of the area of the diffuser exit.

* * * * *

UNITED STATES PATENT AND TRADEMARK OFFICE

CERTIFICATE OF CORRECTION

PATENT NO. : 4,900,225

DATED : February 13, 1990

INVENTOR(S) : J.B. Wulf et al

It is certified that error appears in the above-identified patent and that said Letters Patent is hereby corrected as shown below:

In column 2, line 32 delete the comma after "centrifugal".

In column 3, line 8 delete "14" second occurrence and insert therefor --15--.

Signed and Sealed this

Eleventh Day of December, 1990

*Attest:*

HARRY F. MANBECK, JR.

*Attesting Officer*

*Commissioner of Patents and Trademarks*